US007435112B1

(12) United States Patent
Miller et al.

(10) Patent No.: US 7,435,112 B1
(45) Date of Patent: Oct. 14, 2008

(54) ELECTRICAL CONNECTOR HAVING A MECHANICAL MATING CYCLE LIMITATION

(75) Inventors: Keith Edwin Miller, Manheim, PA (US); William David Irwin, Elizabethtown, PA (US); Lawrence John Brekosky, Dillsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 12/028,080

(22) Filed: Feb. 8, 2008

(51) Int. Cl.
*H01R 13/44* (2006.01)

(52) U.S. Cl. ..... 439/141; 439/133; 439/312; 439/307; 439/680

(58) Field of Classification Search ..... 439/133, 439/141, 312, 307, 318, 319, 354, 680, 681
See application file for complete search history.

(56) References Cited

U.S. PATENT DOCUMENTS

| | | | | |
|---|---|---|---|---|
| 4,927,374 | A * | 5/1990 | Batty | 439/310 |
| 5,857,866 | A * | 1/1999 | Felps | 439/289 |
| 6,602,093 | B1 * | 8/2003 | Cannon | 439/578 |
| 6,619,876 | B2 * | 9/2003 | Vaitkus et al. | 403/349 |
| 6,712,647 | B2 * | 3/2004 | Khemakhem et al. | 439/620.03 |
| 6,790,080 | B2 * | 9/2004 | Cannon | 439/551 |
| 6,846,996 | B2 | 1/2005 | Kent et al. | |
| 6,884,099 | B1 * | 4/2005 | Cannon | 439/318 |
| 7,075,023 | B2 | 7/2006 | Kent et al. | |
| 7,081,001 | B1 * | 7/2006 | Conroy et al. | 439/314 |
| 7,153,153 | B1 * | 12/2006 | Conroy et al. | 439/314 |
| 7,256,362 | B2 | 8/2007 | Kent et al. | |
| 7,273,992 | B2 | 9/2007 | Kent et al. | |
| 7,354,289 | B2 * | 4/2008 | Cannon | 439/314 |
| 2004/0018764 | A1 * | 1/2004 | Thurston | 439/312 |
| 2007/0149011 | A1 | 6/2007 | Kent et al. | |
| 2007/0281532 | A1 * | 12/2007 | Cannon | 439/318 |

FOREIGN PATENT DOCUMENTS

| | | | |
|---|---|---|---|
| WO | 2004057630 | A2 | 7/2004 |
| WO | 2004075349 | A3 | 9/2004 |

* cited by examiner

*Primary Examiner*—Tulsidsa C. Patel
*Assistant Examiner*—Harshad C Patel

(57) ABSTRACT

An electrical connector having a mechanical mating cycle limitation that renders the connector inoperable after a predetermined number of mating cycles is disclosed. The electrical connector includes a rotating component that rotates within the connector for the predetermined number of mating cycles until the rotating component is prohibited from further rotation, which prevents the connector from further mating, thereby rendering the connector inoperable.

14 Claims, 7 Drawing Sheets

ELECTRICAL CONNECTOR HAVING A MECHANICAL MATING CYCLE LIMITATION

FIELD OF THE INVENTION

The present invention relates generally to electrical connectors. More specifically, the present invention relates to an electrical connector that includes a mechanical mating cycle limiter that renders the connector inoperable after a predetermined number of mating cycles.

BACKGROUND OF THE INVENTION

Current methods to limit the number of uses of electrical devices, such as those used in surgical procedures or other health or medical related applications, have relied upon regulatory actions subject to penalties for non-compliance. For example, medical devices may be required to limit the number of uses because of efficacy, sterility, and to limit cross contamination. However, such self-regulation may be difficult due to the high cost and limited availability of these medical devices.

Electrical circuits with associated software may be used to limit the number of times a device may be used. However, the systems and methods using this type of control are expensive, difficult to retrofit, and subject to failure from exposure to sterilization procedures.

Additionally, mechanical limiter devices have been proposed that can be incorporated in the interface between the device and a panel or receptacle to which the device is connected for use. However, these mechanical limiters may be subject to tampering or removal.

Thus, there is a need for a system and method that limits the number of uses of a device, such as a medical device, that is inexpensive, reliable and difficult to disable.

SUMMARY OF THE INVENTION

In one embodiment of the invention, an electrical connector for providing an electrical connection to a receptacle assembly is disclosed that includes a plug housing, contacts disposed within the plug housing, a midpiece having outer ramps disposed therewithin, the midpiece securely assembled to the plug housing. The connector also include a plunger component, a rotating component, and a spring disposed within the securely assembled plug housing and midpiece. The plug housing includes an insertion portion, a shell, and inner ramps disposed within the plug housing. The rotating component is configured to rotate within the electrical connector when mating and unmating the electrical connector to the receptacle assembly for a predetermined number of mating cycles until the rotating component is prohibited from further rotation during a mating cycle, thereby preventing the mating of the electrical connector to the receptacle assembly and rendering the electrical connector inoperable.

In another embodiment of the invention, a method of rendering an electrical connector inoperable after a predetermined number of mating cycles is disclosed that includes providing an electrical connector including a plug housing, contacts disposed within the plug housing, a midpiece having outer ramps disposed therewithin, the midpiece securely assembled to the plug housing. The plug housing includes an insertion portion, a shell, and inner ramps disposed within the plug housing. The connector also includes a plunger component, a rotating component, and spring disposed within the securely assembled plug housing and midpiece. The act of mating and unmating the electrical connector to the receptacle assembly rotates the rotating component within the connector for a predetermined number of mating cycles until the rotating component is prohibited from further rotation during a mating cycle, thereby preventing the mating of the electrical connector to the receptacle assembly and rendering the electrical connector inoperable.

Further aspects of the method and system are disclosed herein. The features as discussed above, as well as other features and advantages of the present invention will be appreciated and understood by those skilled in the art from the following detailed description and drawings.

BRIEF DESCRIPTION OF THE DRAWINGS

Wherever possible, the same reference numbers will be used throughout the drawings to refer to the same or like parts.

DETAILED DESCRIPTION OF THE INVENTION

The present invention now will be described more fully hereinafter with reference to the accompanying drawings, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
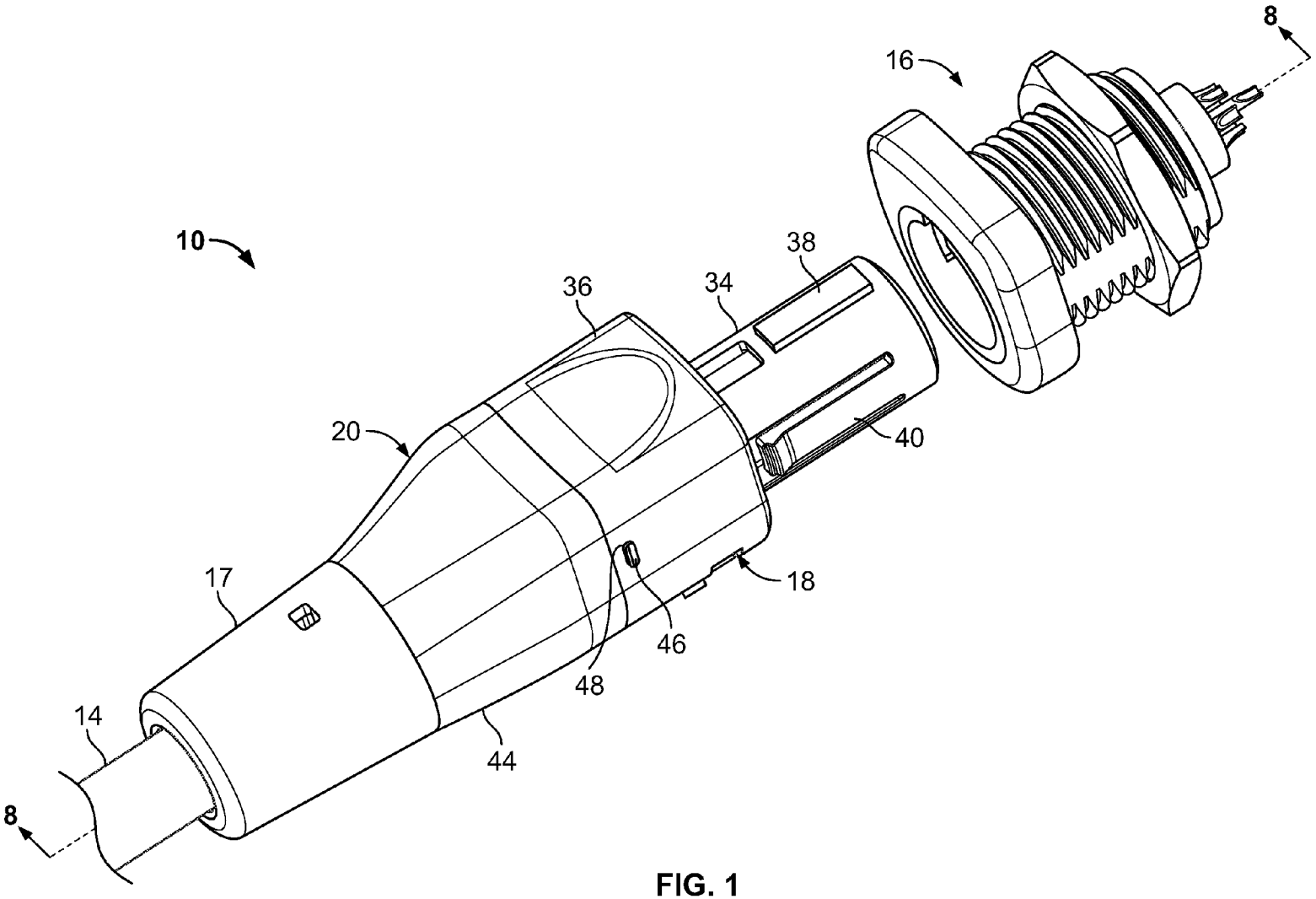
FIG. 1 illustrates an exemplary electrical connector of the present invention with an unmated exemplary receptacle assembly.
Figure 2:
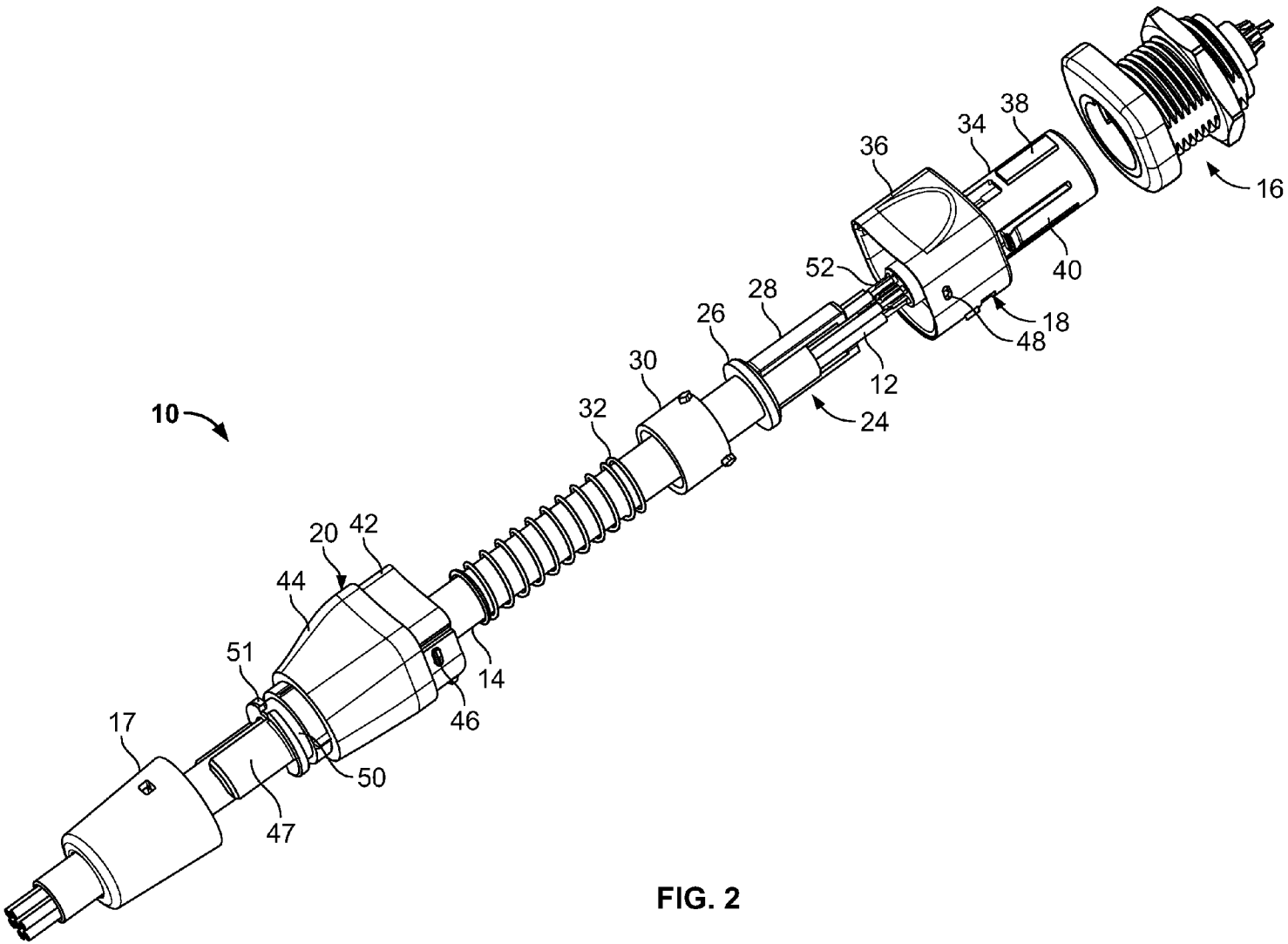
FIG. 2 illustrates an exploded view of the exemplary electrical connector of FIG. 1 with the receptacle assembly.

With reference to FIGS. 1 and 2, an exemplary embodiment of a limited use connector 10 for terminating wires 12 of cable 14 and providing an electrical connection to a receptacle assembly 16 is disclosed. The connector 10 includes a plug housing 18, a midpiece 20, and a rotating clamp 17.

As shown in FIG. 2, the connector 10 further includes a plunger component 24, a rotating component 30, and a resilient device such as a spring 32. The plunger component 24 includes a plunger ring 26 having plunger arms 28 extending therefrom.

The midpiece 20 includes an aligning section 42 and a midpiece shell 44. The aligning section 42 includes protrusions 46 (a protrusion 46 is present but not shown on the opposite side of the aligning section 42). The midpiece 20 further includes cable retention fingers 47 that extend from the midpiece shell 44 that, in conjunction with the rotating clamp 17, provides strain relief to the cable 14. The midpiece 20 additionally includes a groove 50 and retention ring 51 for engaging the rotating clamp 17, thereby securely assembling the rotating clamp 17 to the midpiece 20.

Referring again to FIGS. 1 and 2, the plug housing 18 includes an insertion portion 34 and a shell 36. The insertion portion 34 includes a guide protrusion 38 and compliant spring arms 40 (a compliant spring arm is present but not shown on the opposite side of the insertion portion 34) for aligning and retention of the connector 10 to the receptacle assembly 16, respectively. Alternatively, the insertion portion 34 may have other shapes and arrangements of the guide protrusion 38 and compliant spring arms 40 as would be appreciated by one of ordinary skill in the art for guiding and mating the connector 10 to the receptacle assembly 16. Additionally, although the insertion portion 34 in this exemplary embodiment has a generally cylindrical geometry, other geometries including, but not limited to, square, rectangular and oval may be used in alternative embodiments.

As further shown in FIG. 2, the plug housing 18 also includes recesses 48 (a recess 48 is present but not shown on the opposite side of the plug housing 18) configured to receive protrusions 46 of the midpiece 20 so as to securely assemble the plug housing 18 and midpiece 20. In alternative embodiments of the invention, the plug housing 18 may be securely assembled to the midpiece 20 by alternative configurations of protrusions, tabs, recesses and indentations as would be appreciated by one of ordinary skill in the art.

The plug housing 18 also includes pin contacts 52, which terminate wires 12 of the cable 14. The pin contacts 52 are configured to mate with corresponding socket contacts (312, shown on FIG. 3) disposed within the receptacle assembly 16. The number of wires 12 and pin contacts 52 may vary based on the size and application of the connector 10. In an alternative embodiment of the invention, the pin contacts 52 and the socket contacts (312, shown on FIG. 3) may be reversely disposed in the receptacle assembly 16 and the plug housing 18, respectively. Also the plug housing 18 and receptacle assembly 16 could use other methods of electrical contact including but not limited to blade and beam, spring pins and pads, card edge, etc.

The rotating clamp 17 and cable retention fingers 47 provide strain relief to the cable 14 to prohibit the wires 12 from becoming unintentionally disconnected from the connector 10. The rotating clamp 17 is configured to provide a compressive force upon the cable retention fingers 47 when the rotating clamp 17 is securely assembled to the midpiece 20, the compressive force compressing the cable retention fingers 47 around the cable 14. The cable clamp 17 and midpiece 20 are further disclosed in U.S. patent application Ser. No. 12/027,339 filed 7 Feb. 2008, which is hereby incorporated by reference in its entirety. In alternative embodiments of the invention, alternative strain relief devices, including, but not limited to cap and ferrule, wire ties, and split clamping housings may be used in place of the rotating clamp 17, with modification made to the midpiece 20 to accept the alternative strain relief device as would be appreciated by one of ordinary skill in the art.

Figure 3:
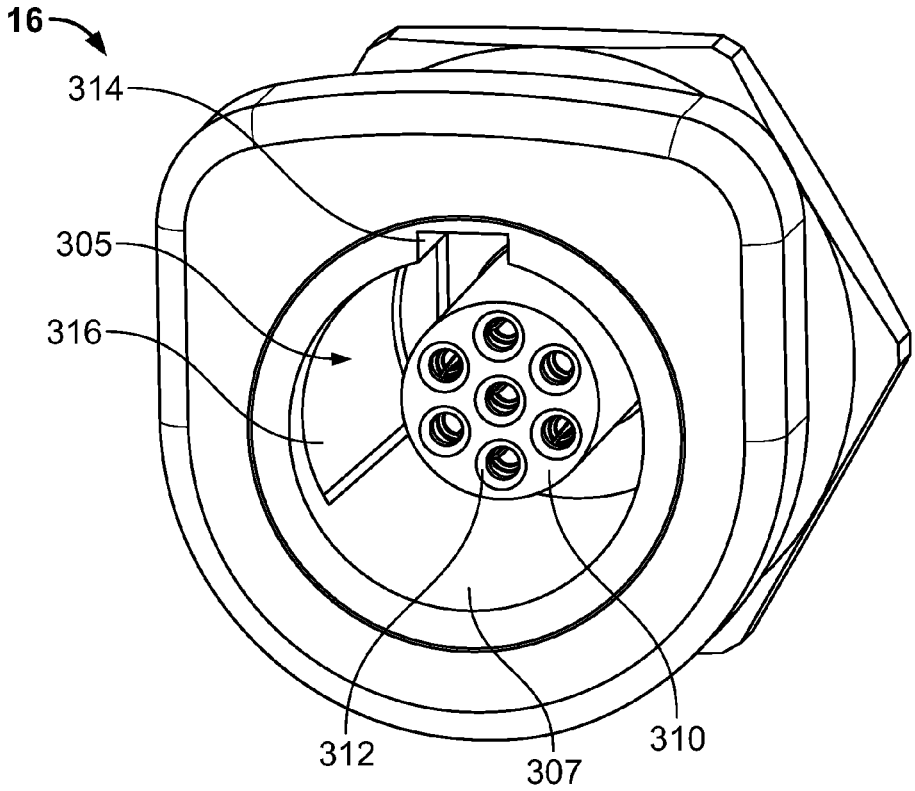
FIG. 3 illustrates a front perspective view of the receptacle assembly of FIG. 1.

A front view of the receptacle assembly 16 is shown in FIG. 3. As can be seen in FIG. 3, the receptacle assembly 16 includes an inner space 305 configured to receive insertion portion 34 (FIGS. 1 and 2). The inner space 305 is at least partially defined by an inner cylindrical surface 307. Disposed within the inner space 305 is a contact housing 310 containing socket contacts 312. The inner cylindrical surface 307 includes a guide slot 314 configured to receive corresponding guide protrusion 38 (FIGS. 1 and 2) and receiving arm slots 316 configured to receive corresponding compliant spring arms 40 (FIGS. 1 and 2). As will be appreciated by one of ordinary skill in the art, the geometry and arrangement of the inner space 305, guide slot 314 and receiving arm slots 316 may vary in alternative embodiments to correspond to the geometry and arrangement of the corresponding mating elements of the connector 10 (FIGS. 1 and 2).

Figure 4:
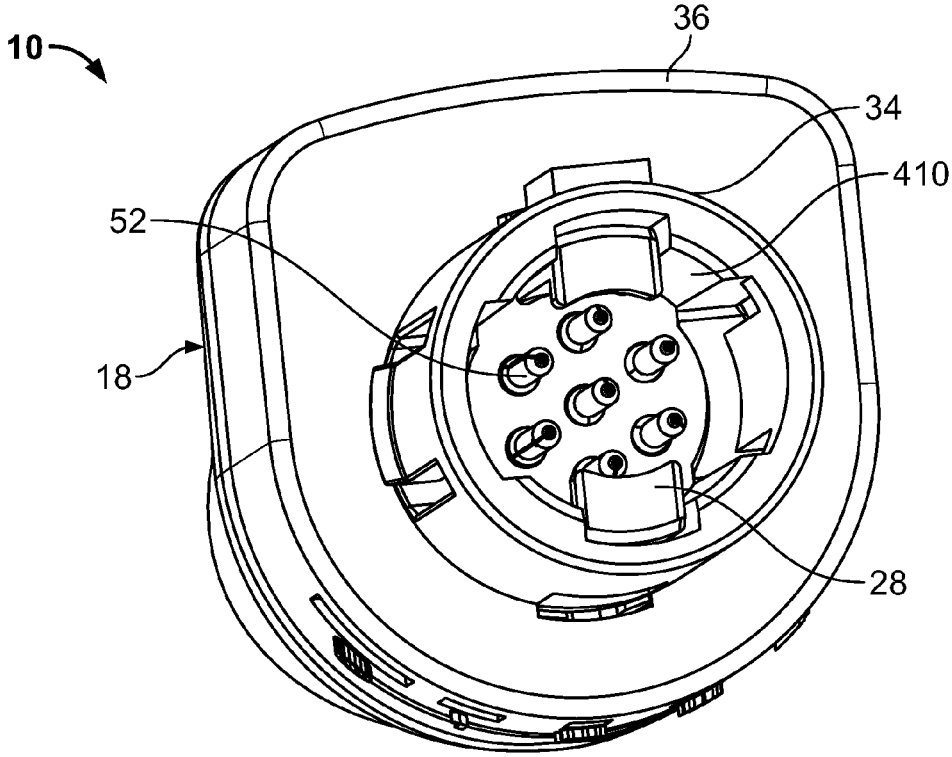
FIG. 4 illustrates a front perspective view of the exemplary electrical connector of FIG. 1.

A front view of the connector 10 is shown in FIG. 4. As can be seen in FIG. 4, the insertion portion 34 of the plug housing 18 includes an insertion portion inner cylindrical surface 410. The plunger arms 28 extend along the insertion portion inner cylindrical surface 410 of the insertion portion 34 as shown when the connector 10 is not mated to the receptacle assembly 16 (FIGS. 1 and 2). The pin contacts 52 are disposed and configured within the insertion portion 34 so as to mate with corresponding socket contacts 312 of the receptacle assembly 16 (FIG. 3).

Figure 5:
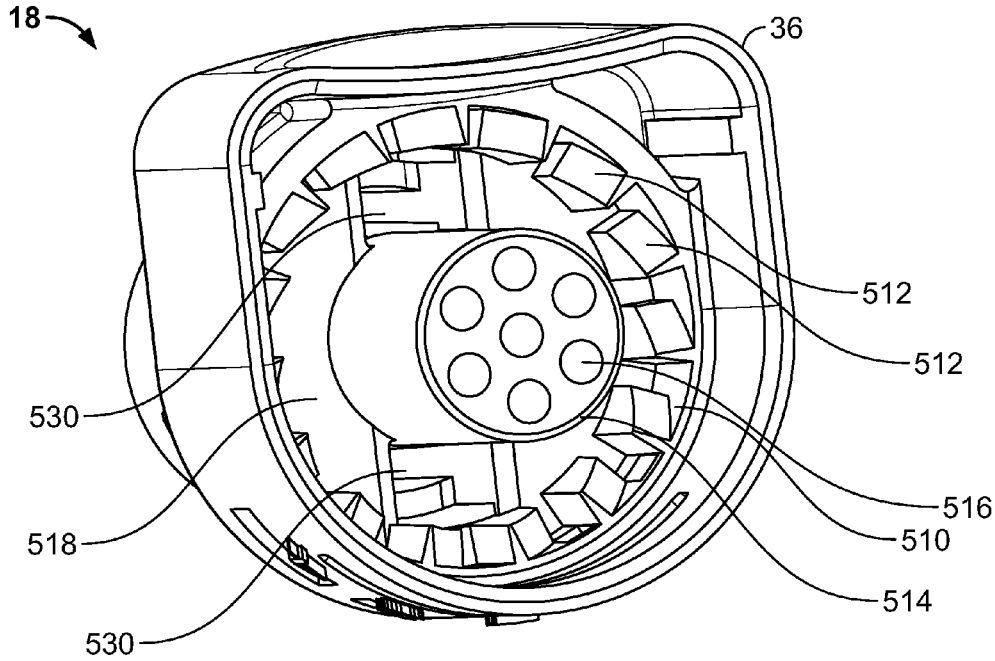
FIG. 5 illustrates a rear perspective view of a plug housing according to an embodiment of the present invention.

A rear view of the plug housing 18 with the pin contacts 52 removed therefrom is shown in FIG. 5. As can be seen in FIG. 5, the plug housing 18 further includes a rear inner cylindrical surface 510 disposed within the shell 36, the rear inner cylindrical surface 510 including inner ramps 512 radially disposed about the circumference thereof. As can also be seen in FIG. 5, the plug housing 18 additionally includes a cylindrical contact housing 514 disposed therewithin. The cylindrical contact housing 514 includes cavities 516 for receiving pin contacts 52 (FIG. 4). The plug housing 18 also includes a rear wall 518 disposed at least partially around the cylindrical contact housing 514. The plug housing 18 further includes plunger slots 530 for receiving plunger arms 28 of the plunger component 24 (FIG. 2). The plunger slots 530 and cylindrical contact housing 514 are configured to receive the plunger component 24 so that the plunger ring 26 is capable of being inserted over the cylindrical contact housing 514 and slid up to the rear wall 518.

Figure 6:
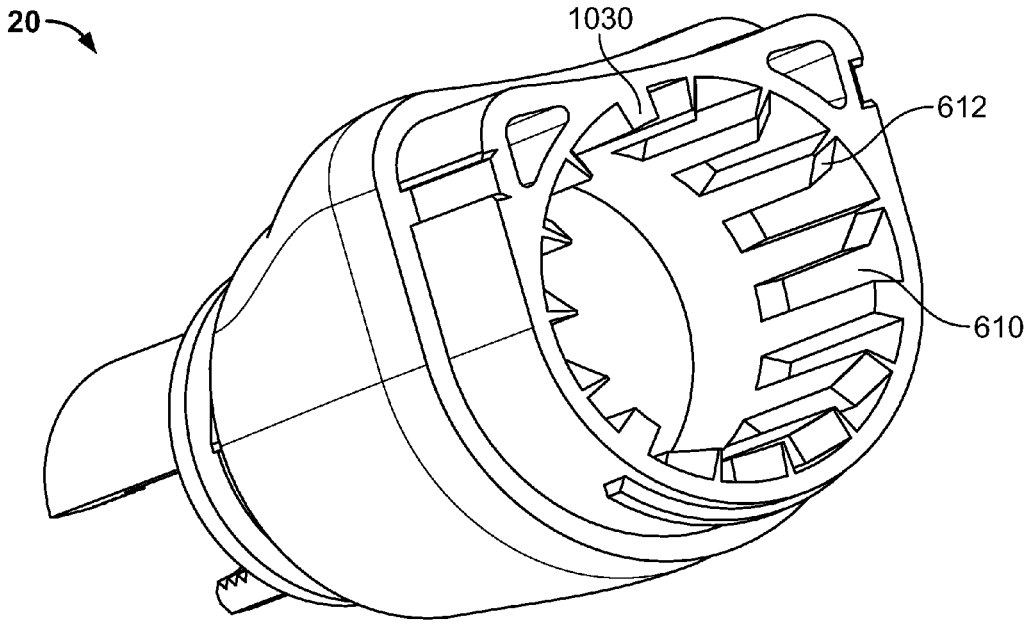
FIG. 6 illustrates a front perspective view of a midpiece according to an embodiment of the present invention.

A front view of the midpiece 20 is shown in FIG. 6. As can be seen in FIG. 6, the midpiece 20 includes a midpiece inner cylindrical surface 610. The midpiece inner cylindrical surface 610 includes outer ramps 612 radially disposed about the circumference thereof. The midpiece 20 further includes an inner rear wall 710 (see FIG. 7).

Figure 7:
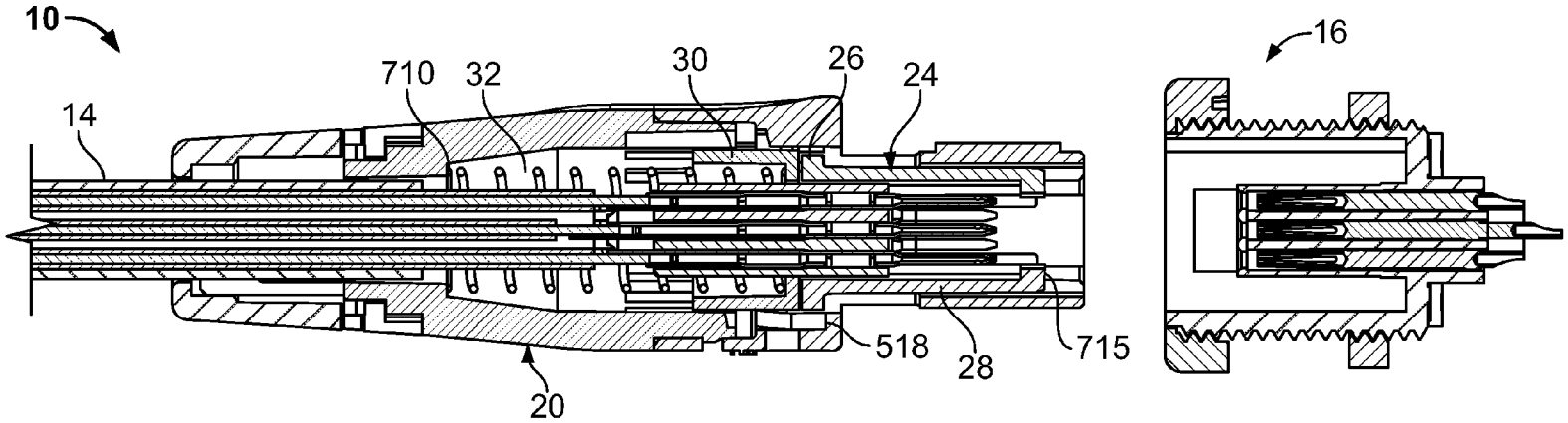
FIG. 7 illustrates a cross sectional view of the exemplary electrical connector and receptacle assembly of FIG. 1 taken along line 8-8.

A cross sectional view of the connector 10 and receptacle assembly 16 as shown unmated in FIG. 1 and taken along line 8-8 of FIG. 1 is shown in FIG. 7. As can be seen in FIG. 7, the spring 32, which is disposed at one end against inner rear wall 710 of the midpiece 20, urges the rotating component 30 against the plunger ring 26 of the plunger component 24. The plunger ring 26 is urged into an unmated resting position against the rear wall 518 of the plug housing 18. As can be further seen in FIG. 7, the plunger component 24 further includes plunger push surfaces 715 disposed at one end of the plunger arms 28.

Figure 8:
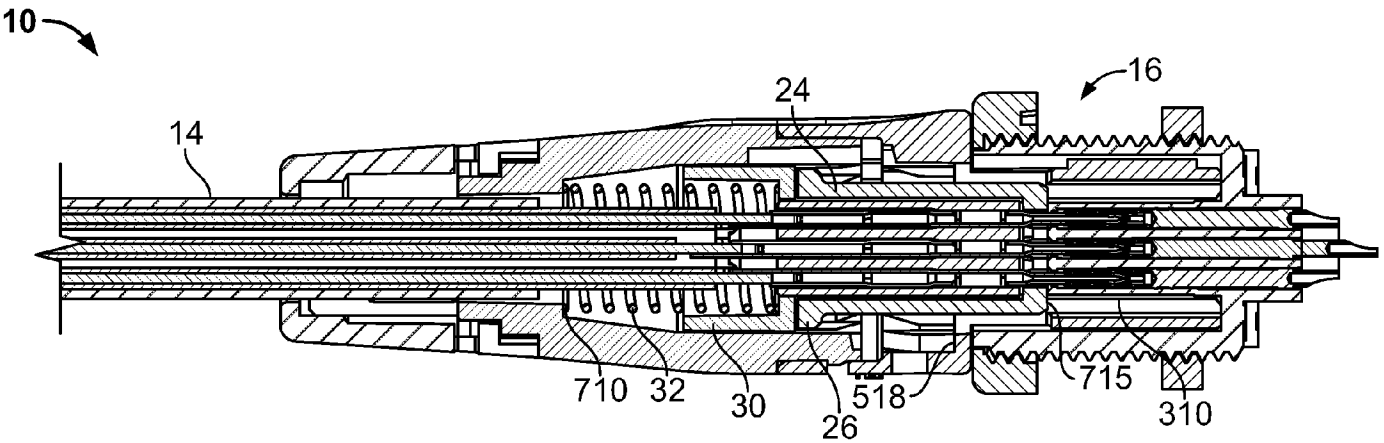
FIG. 8 illustrates a cross sectional view of the exemplary electrical connector and receptacle assembly of FIG. 1 taken along line 8-8 after mating.

A cross sectional view of the connector 10 and receptacle assembly 16 of FIG. 1 after mating is shown in FIG. 8. As can be seen in FIG. 8, the cylindrical contact housing 310 of the receptacle assembly 16 has contacted the plunger push surfaces 715 and urged the plunger ring 26 away from the rear wall 518 of the plug housing 18, thereby urging the rotating component 30 and compressing the spring 32 towards the inner rear wall 710 of the midpiece 20.

Figure 9:
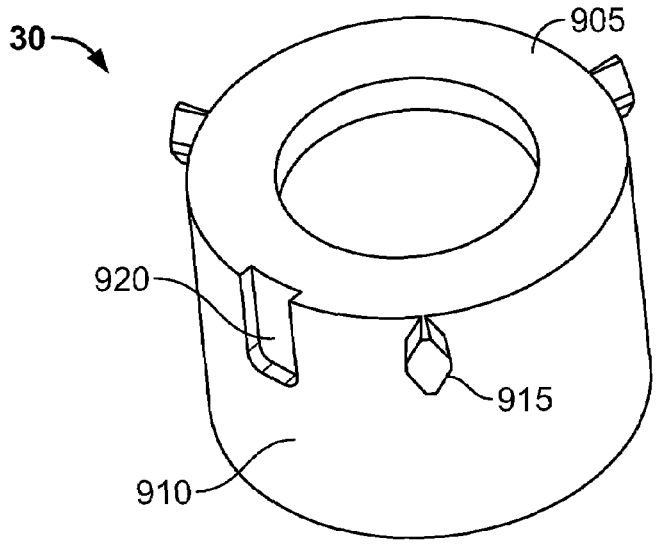
FIG. 9 illustrates a top perspective view of a rotating component according to an embodiment of the present invention.

The actions of mating and unmating the connector 10 and the receptacle assembly 16 rotates the rotating component 30 up to a predetermined number of mating cycles until the rotating component 30 is prohibited from further rotation rendering the connector 10 unmatable, thereby inoperable, as will be discussed by referring to FIGS. 9 and 10. As can be seen in FIG. 9, the rotating component 30 includes a top surface 905 and an outer cylindrical surface 910. The outer cylindrical surface 910 has drive lugs 915 disposed thereupon, proximate to the top surface 905. In this exemplary embodiment, the outer cylindrical surface 910 has three drive lugs 915 equally radially disposed around the circumference thereof, however, in alternative embodiments, the number of drive lugs may be one, two or more than three. The outer cylindrical surface 910 also has a recess 920 disposed therethrough, also proximate the top surface 905.

Figure 10:
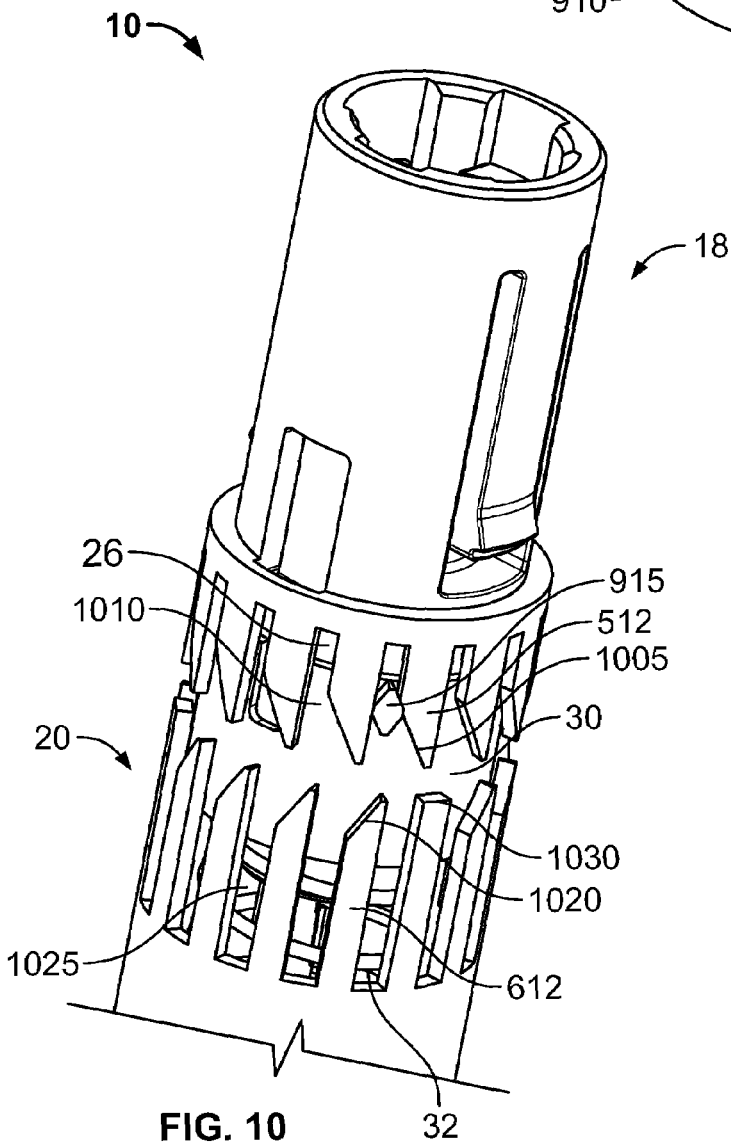
FIG. 10 illustrates a partial cut away view of the exemplary connector of FIG. 1.

FIG. 10 shows the position of the rotating component 30 within the connector 10 when the connector is in the unmated position as shown in FIGS. 1 and 7. Portions of the plug housing 18 and midpiece 20 have been cut away to show the relative position of the inner ramps 512 and the outer ramps 612 of the plug housing 18 and the midpiece 20, respectively. As can be seen in FIG. 10, the inner ramps 512 include beveled edges 1005, and the inner ramps 512 are separated from one another by inner gaps 1010. As can be further seen in FIG. 10, the outer ramps 612 include beveled edges 1020, and the outer ramps 612 are separated from one another by outer gaps 1025. Additionally, disposed between the outer ramps 612 is a stop surface 1030.

As can be seen in FIG. 10, the rotating component 30 is urged against the plunger ring 26 by the spring 32. When the connector 10 is mated with the receptacle assembly 16, the plunger ring 26 is urged toward the rotating component 30 as described above, the spring 32 is compressed, and the drive lugs 915 are urged towards the outer ramps 612. The drive lugs 915 contact the beveled edges 1020 of the outer ramps 612, which forces the rotating component 30 to rotate. The rotating component 30 is further urged towards the outer ramps 612 and the drive lugs 915 are received in the outer gaps 1025 until the connector 10 and receptacle assembly 16 are mated.

When the connector 10 and the receptacle assembly 16 are unmated, the rotating component 30 is urged towards the plunger ring 26 by the spring 32 by the spring 32, and the drive lugs 915 are urged towards the inner ramps 512. The drive lugs 915 contact the beveled edges 1005 of the inner ramps 512, which forces the rotating component 30 to rotate. The rotating component 30 is further urged towards the inner ramps 512 and the drive lugs 915 are received in the inner gaps 1010 until the connector 10 and receptacle assembly 16 are unmated.

By mating and unmating the connector 10 from the receptacle assembly 16 as described above, the rotating component 30 is rotated within the connector 10 until the drive lugs 915 contact the stop surface 1030 while attempting to mate the connector 10 to the receptacle assembly 16. When this occurs, the rotating component 30 is prohibited from being further urged towards the outer ramps 612, which prohibits the plunger component 24 (FIGS. 7 and 8) from being further urged towards the rotating component 30, thus prohibiting the connector 10 and receptacle assembly 16 from mating. The number of mating cycles before the connector 10 is rendered inoperable can be predetermined by selecting the number and position of drive lugs 915 relative to the number of inner and outer ramps 512, 612 and the stop surface 1030. As would be appreciated by one of ordinary skill in the art, the number of mating cycles can also be predetermined by the assembled orientation of the rotating component 30 relative to the plug housing 18.

Figure 11:
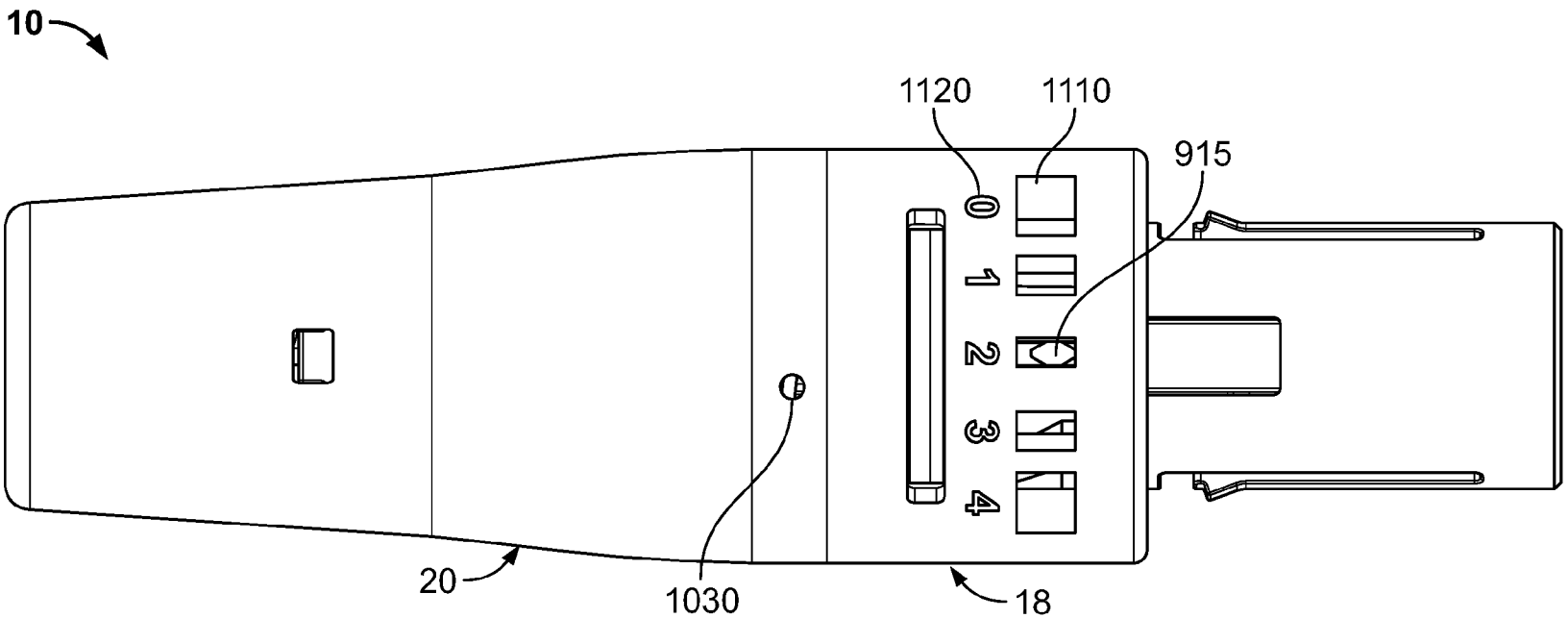
FIG. 11 illustrates an alternative embodiment of the electrical connector according to the invention.

As shown in FIG. 11, the plug housing 18 may be provided with optional openings 1110 having corresponding reference numerals 1120 to view the position of a particular drive lug 915 within the connector 10 to provide a visual indication or display of the number of mating cycles that the connector 10 has performed, as well as display the number of mating cycles still available before the connector 10 is rendered inoperable. Reference numerals 1120 could be an integral part of the plug housing 18 as shown, or in alternative embodiments, could be marked with ink, applied as a label, or otherwise provided as known in the art. Additionally, as shown in FIG. 11, the midpiece 20 may be provided with a hole 1030 positioned and configured to permit a pin or other similar tool access to the recess 920 in the rotating component 30, thereby restricting the motion of the rotating component 30 during a mating cycle for testing purposes.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector having a mechanical mating cycle limitation for providing an electrical connection to a receptacle assembly, comprising:

a plug housing comprising an insertion portion, a shell, and inner ramps disposed therewithin;

contacts disposed within the plug housing;

a midpiece comprising outer ramps disposed therewithin, the midpiece securely assembled to the plug housing; and a plunger component, a rotating component, and a spring disposed within the securely assembled midpiece and plug housing;

wherein the rotating component is configured to rotate within the electrical connector when mating and unmating the electrical connector to the receptacle assembly for a predetermined number of mating cycles until the rotating component is prohibited from further rotation during a mating cycle, thereby rendering the electrical connector inoperable.

2. The electrical connector of claim 1, wherein the rotating component is urged towards the outer ramps by the plunger when the electrical connector is mated to the receptacle assembly.

3. The electrical connector of claim 1, wherein the rotating component is urged towards the inner ramps by the spring when the electrical connector is unmated from the receptacle assembly.

4. The electrical connector of claim 1, wherein a stop surface is disposed within the inner ramps that contacts a drive lug disposed on a surface of the rotating component when mating the electrical connector to the receptacle assembly so as to prohibit the plunger from being urged towards the rotating component thereby prohibiting the electrical connector from mating to the receptacle assembly after the predetermined number of mating cycles.

5. The electrical connector of claim 1, further comprising a visual indicator on the electrical connector displaying the number of mating cycles the electrical connector has performed.

6. The electrical connector of claim 1, further comprising a hole in the connector configured to provide access for a tool to engage the rotating component to prevent the rotating component from rotating within the electrical connector during a mating cycle.

7. The electrical connector of claim 1, further comprising a strain relief device.

8. A method of preventing the mating of an electrical connector after a predetermined number of mating cycles, thereby rendering the electrical connector inoperable, comprising:

providing an electrical connector comprising:

a plug housing comprising an insertion portion, a shell, and inner ramps disposed therewithin;

contacts disposed within the plug housing;

a midpiece comprising outer ramps disposed therewithin, the midpiece securely assembled to the plug housing; and a plunger, a rotating component, and a spring disposed within the securely assembled plug housing and midpiece;

wherein the rotating component is configured to rotate within the electrical connector when mating and unmating the electrical connector to the receptacle assembly for a predetermined number of mating cycles until the rotating component is prohibited from further rotation during a mating cycle, thereby preventing the electrical connector from further mating to the receptacle assembly, thereby rendering the electrical connector inoperable; and mating and unmating the electrical connector to the receptacle assembly for the predetermined number of mating cycles until the electrical connector is rendered inoperable.

9. The method of claim 8, wherein the rotating component is urged towards the outer ramps by the plunger when the electrical connector is mated to the receptacle assembly.

10. The method of claim 8, wherein the rotating component is urged towards the inner ramps by the spring when the electrical connector is unmated from the receptacle assembly.

11. The method of claim 8, wherein a stop surface is disposed within the outer ramps that contacts a drive lug disposed on a surface of the rotating component when mating the electrical connector to the receptacle assembly so as to prohibit the plunger from being urged towards the rotating component thereby prohibiting the electrical connector from mating to the receptacle assembly after the predetermined number of mating cycles.

12. The method of claim 8, further comprising a visual indicator on the electrical connector displaying the number of mating cycles the electrical connector has performed.

13. The method of claim 8, further comprising a hole in the connector configured to provide access for a tool to engage the rotating component to prevent the rotating component from rotating within the electrical connector during a mating cycle.

14. The method of claim 8, further comprising a strain relief device.

* * * * *